US008322751B2

(12) United States Patent
Fessl

(10) Patent No.: US 8,322,751 B2
(45) Date of Patent: Dec. 4, 2012

(54) SECURITY THREAD HAVING AN OPTICALLY VARIABLE SECURITY FEATURE

(75) Inventor: Marion Fessl, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 685 days.

(21) Appl. No.: 11/779,707

(22) Filed: Jul. 18, 2007

(65) Prior Publication Data

US 2008/0079257 A1 Apr. 3, 2008

(30) Foreign Application Priority Data

Jul. 21, 2006 (DE) ..... 10 2006 033 839
Aug. 22, 2006 (DE) ..... 10 2006 039 305

(51) Int. Cl.
*B42D 15/00* (2006.01)
*B42D 15/10* (2006.01)

(52) U.S. Cl. ..... 283/72; 162/105; 162/140

(58) Field of Classification Search ..... 283/72; 162/105, 140
See application file for complete search history.

(56) References Cited

U.S. PATENT DOCUMENTS

| | | | | |
|---|---|---|---|---|
| 5,388,862 | A * | 2/1995 | Edwards | 283/82 |
| 6,616,803 | B1 | 9/2003 | Isherwood et al. | |
| 6,861,388 | B2 | 3/2005 | Ishibashi et al. | |
| 7,153,557 | B2 * | 12/2006 | Rancien | 428/40.2 |
| 7,179,393 | B2 | 2/2007 | Isherwood et al. | |
| 2005/0040641 | A1 | 2/2005 | Cote et al. | |
| 2007/0165182 | A1 | 7/2007 | Hoffmuller | |
| 2007/0211238 | A1 | 9/2007 | Hoffmuller | |
| 2007/0216518 | A1 | 9/2007 | Hoffmuller | |
| 2007/0229928 | A1 | 10/2007 | Hoffmuller | |
| 2007/0241551 | A1 | 10/2007 | Heim | |
| 2007/0246933 | A1 | 10/2007 | Heim | |
| 2007/0274559 | A1 | 11/2007 | Depta | |
| 2008/0014378 | A1 | 1/2008 | Hoffmuller | |
| 2008/0054621 | A1 | 3/2008 | Burchard | |
| 2008/0079257 | A1 | 4/2008 | Fessl | |
| 2008/0088859 | A1 | 4/2008 | Depta | |
| 2008/0160226 | A1 | 7/2008 | Kaule | |
| 2008/0163994 | A1 | 7/2008 | Hoppe | |
| 2008/0198468 | A1 | 8/2008 | Kaule | |
| 2008/0216976 | A1 | 9/2008 | Ruck | |
| 2008/0250954 | A1 | 10/2008 | Depta | |
| 2008/0258456 | A1 | 10/2008 | Rahm | |

FOREIGN PATENT DOCUMENTS

| | | |
|---|---|---|
| AU | 2003279357 | 6/2004 |
| WO | WO 2004041546 | 5/2004 |
| WO | WO 2005105473 | 11/2005 |
| WO | WO 2005105474 | 11/2005 |
| WO | WO 2005105475 | 11/2005 |
| WO | WO 2005108106 | 11/2005 |
| WO | WO 2005108108 | 11/2005 |
| WO | WO 2005108110 | 11/2005 |
| WO | WO 2006005434 | 1/2006 |

(Continued)

*Primary Examiner* — Dana Ross
*Assistant Examiner* — Kyle Grabowski
(74) *Attorney, Agent, or Firm* — Greenlee Sullivan P.C.

(57) ABSTRACT

Embodiments disclosed herein include such relating to security elements for embedment in security papers, value documents and the like, having a substrate foil having opposing first and second main surfaces, an optically variable security feature disposed on the first main surface and an adhesive layer applied to the second main surface. Further embodiments are disclosed including methods for manufacturing security elements, embodiments relating to security papers and value documents, and other embodiments.

17 Claims, 2 Drawing Sheets

FOREIGN PATENT DOCUMENTS

| | | |
|---|---|---|
| WO | WO 2006015733 | 2/2006 |
| WO | WO 2006018171 | 2/2006 |
| WO | WO 2006018172 | 2/2006 |
| WO | WO 2006040069 | 4/2006 |
| WO | WO 2006056342 | 6/2006 |
| WO | WO 2006072380 | 7/2006 |
| WO | WO 2006087138 | 8/2006 |
| WO | WO 2006099971 | 9/2006 |
| WO | WO 2006119896 | 11/2006 |
| WO | WO 2006128607 | 12/2006 |
| WO | WO 2007006445 | 1/2007 |
| WO | WO 2007006455 | 1/2007 |
| WO | WO 2007076952 | 7/2007 |
| WO | WO 2007079851 | 7/2007 |
| WO | WO 2007115648 | 10/2007 |

* cited by examiner

SECURITY THREAD HAVING AN OPTICALLY VARIABLE SECURITY FEATURE

CROSS-REFERENCES TO RELATED APPLICATIONS

This application is a nonprovisional application claiming the benefit of German Application Nos. DE 10 2006 033 839.1 filed Jul. 21, 2006 and DE 10 2006 039 305.8 filed Aug. 22, 2006, each of which are herein incorporated by reference in entirety to the extent not inconsistent herewith.

The present invention relates to a security element for embedment in security papers, value documents and the like, having a substrate foil having opposing first and second main surfaces, an optically variable security feature disposed on the first main surface and an adhesive layer applied to the second main surface.

For protection, value documents, such as banknotes, stocks, bonds, certificates, vouchers, checks, valuable admission tickets and other papers that are at risk of counterfeiting, such as passports or other identification documents, are often provided with security elements that permit the authenticity of the value document to be verified, and that simultaneously serve as protection against unauthorized reproduction.

The security elements can be developed, for example, in the form of a security thread that is completely or partially embedded in a banknote. Security elements having viewing-angle-dependent effects play a special role, as these cannot be reproduced even with the most modern copiers. Such security elements are furnished with optically variable patterns, such as diffraction patterns or microlens arrangements, that, from different viewing angles, convey to the viewer a different image impression and, depending on the viewing angle, show for example another color impression and/or another graphic motif.

However, for embedment in security paper or value documents, security threads having optically variable patterns can be coated with adhesive only on the side facing away from the patterns, as otherwise the optically variable patterns are destroyed by the adhesive or glued such that the optically variable effect is no longer perceptible. The anchoring of security threads having optically variable patterns in the substrate is thus less than that of conventional security threads that can be coated with adhesive on both sides.

Based on that, the object of the present invention is to avoid the disadvantages of the background art and especially to realize simultaneously, in a security element, optically variable security features and excellent adhesion in the substrate.

This object is solved by the security element having the features of the main claim. A method for manufacturing such a security element, a security paper and a value document having such a security element are specified in the coordinated claims. Developments of the present invention are the subject of the dependent claims.

According to the present invention, it is provided that, in a generic security element, the first main surface is provided with a structured adhesive layer in the form of patterns, characters or a code. In this way it is ensured that sub-areas of the optically variable security feature are not coated with adhesive and the optical variability of the security element is fully maintained at least in these sub-areas. At the same time, by coating the substrate foil with adhesive layers on both sides, an optimum adhesion of the security thread in the substrate is achieved.

In general, strip-shaped elements or individual elements such as patches can be used as the security element. The security element is preferably a security thread.

In an advantageous embodiment of the present invention, the first main surface is provided with an adhesive layer only outside the region of the optically variable security feature. In this way, the optical variability of the security element is fully maintained. Such a structured adhesive layer can be applied particularly advantageously in register with the optically variable security feature.

Alternatively, the first main surface can be provided with an adhesive layer only in border regions. The central region of the security element is then thoroughly available for optically variable security features. In all embodiments, the adhesive layer of the first main surface can include, as a further authenticating mark, a feature substance, especially a magnetic, electrically conductive, luminescent or infrared-absorbing feature substance.

In an advantageous variant of the present invention, the second main surface is contiguously provided with the adhesive layer. According to another, likewise advantageous, variant, the second main surface is provided with a structured adhesive layer in the form of patterns, characters or a code. Here, too, it is appropriate to apply the structured adhesive layer of the second main surface in register with the optically variable security feature of the first main surface and, if applicable, in register with a structured adhesive layer of the first main surface.

Like the adhesive layer of the first main surface, the adhesive layer of the second main surface can include a feature substance, especially a magnetic, electrically conductive, luminescent or infrared-absorbing feature substance. Here, the adhesive layers of the first and second main surface can also include different feature substances so that different authenticity checks are possible from opposing sides.

The optically variable security feature preferably includes microlenses, a matte pattern, a hologram, a holographic grating image or another hologram-like diffraction pattern.

The present invention also includes a method for manufacturing a security element for embedment in security papers, value documents and the like, in which

- a substrate foil having opposing first and second main surfaces is provided,
- the first main surface is provided with an optically variable security feature,
- the second main surface is provided with an adhesive layer, and
- the first main surface is provided with a structured adhesive layer in the form of patterns, characters or a code.

The present invention further includes a security paper for manufacturing value documents or the like and a value document, such as a banknote, identification card or the like. According to the present invention, the security paper and value document are furnished with an at least partially embedded security element of the kind described above.

Through the present invention, especially the following advantages are realized:

- The optically variable effect of the functional surfaces remains fully maintained with simultaneously improved anchoring of the security element in the substrate at least in sub-areas.
- Through the structured and thus discontiguous application of the adhesive layers, despite excellent adhesion compared with conventional manufacturing methods, adhesive can be economized.
- Contiguous or structured adhesive layers can be combined with feature substances to realize further authenticity features. The adhesive layers then fulfill, in addition to their adhesive function, a further function as a design and/or coding feature.

Through a precisely registered arrangement of optically variable elements and structured adhesive layers, a further authenticity feature can be formed.

Further exemplary embodiments and advantages of the present invention are described below with reference to the drawings. To improve clarity, a depiction to scale and proportion was dispensed with in the drawings.

The invention will now be explained using a banknote as an example. For this, FIG. 1 shows a schematic diagram of a banknote 10 having an embedded security thread 12 according to an exemplary embodiment of the present invention.

Figure 1:
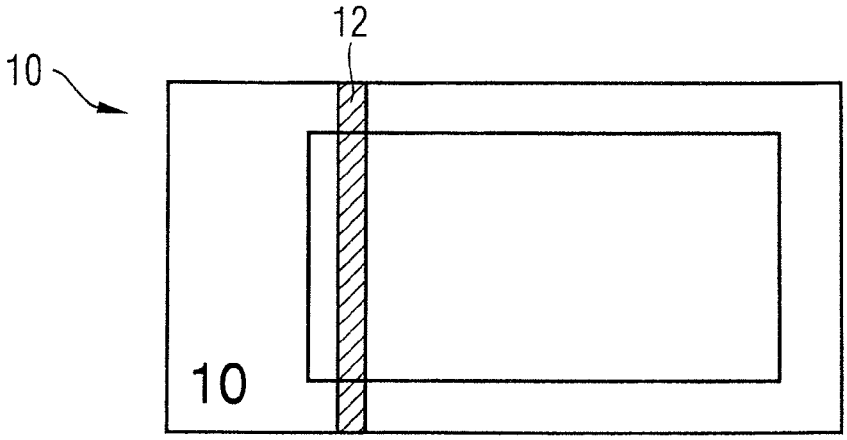
FIG. 1 shows a schematic diagram of a banknote having an embedded security thread according to an exemplary embodiment of the present invention.
Figure 2:
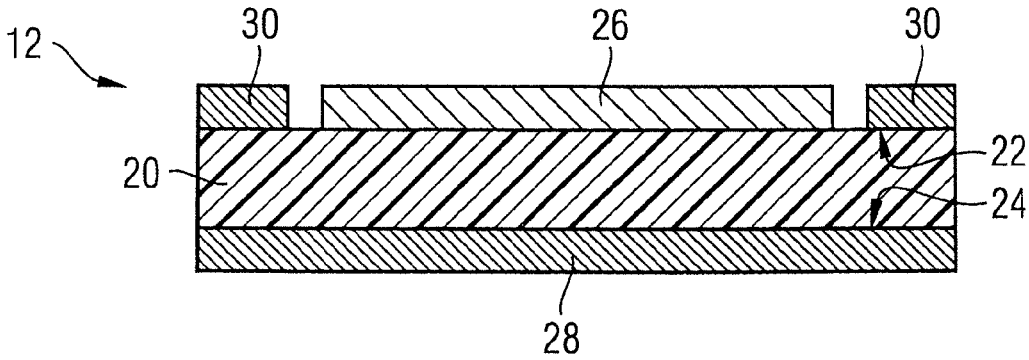
FIG. 2 shows schematically, the layer structure of the security thread in FIG. 1, in cross section.
Figure 3A:
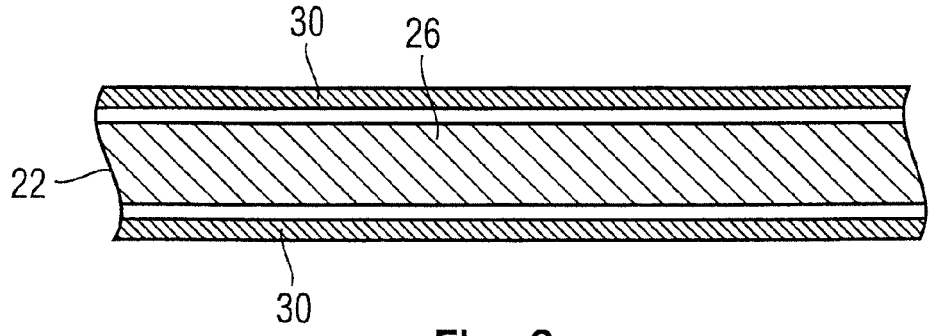
FIG. 3 shows in (a), a top view of the top of the security thread in FIG. 1 and, in (b), a top view of the bottom of the thread.
Figure 3B:
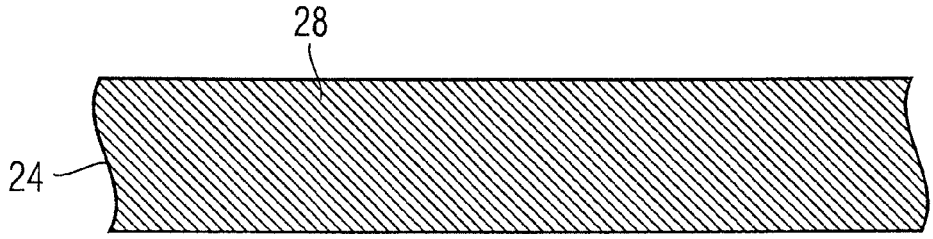

FIG. 2 shows the layer structure of the security thread in FIG. 1 schematically, in cross section, and FIG. 3 shows, in (a), a top view of the top, and in (b), a top view of the bottom of the thread.

With reference to FIG. 2, the security thread 12 exhibits a plastic substrate foil 20 having a first main surface 22 (top) and an opposing second main surface 24 (bottom). On the top 22 is disposed an optically variable security feature 26, for example a microlens arrangement, an embossed pattern, a diffractive pattern, a matte pattern and the like.

For embedding the security thread 12 in the banknote paper, an adhesive layer 28 is applied to the bottom 24 of the substrate foil 20. In addition to the adhesive layer 28, the top 22 of the substrate foil 20 is likewise discontiguously provided with an adhesive layer 30 outside the region of the optically variable security feature 26. Through this measure, on one hand, the full optical variability of the security thread 12 is maintained, and on the other hand, an optimum adhesion of the security thread 12 in the banknote substrate is ensured.

As can best be perceived in FIG. 3, in the exemplary embodiment, the adhesive layer 28 is contiguously applied to the bottom 24 of the substrate foil 20 (FIG. 3(*b*)). On the top 22 of the security thread 12, the adhesive layer 30 is applied along each of the two borders of the substrate foil in a narrow border region (FIG. 3(*a*)). In this way, despite the significantly improved anchoring, almost the entire surface of the substrate foil is nevertheless available for the security feature 26.

Both the adhesive layer 28 of the bottom 24 and the adhesive layer 30 of the top 22 can be applied to the substrate foil 20 in a pattern. Here, it is appropriate to apply the structured adhesive layers 28, 30 in register with the optically variable security feature 26.

Within the security thread, an additional security feature can be created in that one or both adhesive layers 28, 30 are combined with feature substances, such as magnetic, electrically conductive, luminescent or infrared-absorbing feature substances.

Figure 4A:
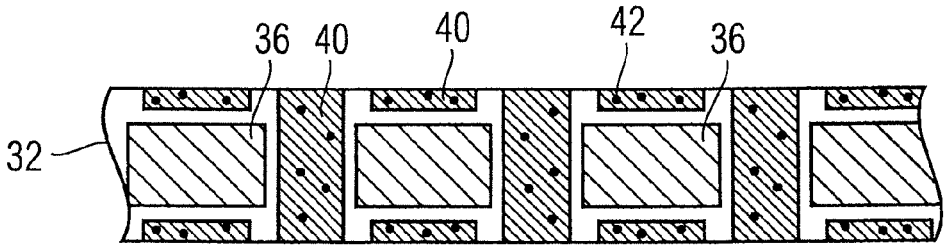
FIG. 4 shows in (a), a top view of the top, and in (b), a top view of the bottom of a security thread according to a further exemplary embodiment of the present invention.
Figure 4B:
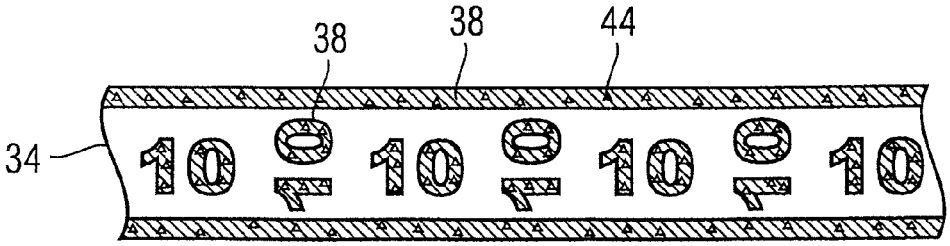

For this, FIG. 4 shows a further exemplary embodiment of a security thread according to the present invention, in which, for illustration, all these additional features are realized. FIG. 4(*a*) shows a top view of the top of the security thread, and FIG. 4(*b*) a top view of the bottom of the thread. Here, the optically variable security feature 36, for example a microlens arrangement, is disposed having regular gaps on the top 32 of the security thread.

In the border regions of the substrate foil and, in addition, in the gaps in the optically variable security feature 36, a patterned adhesive layer 40 is applied register-accurately to the top 32. To the adhesive layer 40 is added a magnetic feature substance 42 that serves as the authenticity feature in a machine check of the security thread.

The bottom 34 of the security thread is likewise provided with a structured adhesive layer 38, whose structure elements are formed by the numeric string "10" corresponding to the denomination of the banknote. Here, the individual structure elements are applied in register with the security features 36 and the structured adhesive layer 40 of the top 32. Furthermore, to the adhesive layer 38 is added a luminescent feature substance 44 so that the numeric strings "10" glow when the banknote is illuminated with UV radiation.

The invention claimed is:

1. A security element for embedment in security papers, value documents and the like, having:

a substrate foil having opposing first and second main surfaces, and an optically variable security feature having viewing-angle-dependent effects disposed on the first main surface;

wherein the first main surface is provided with a first structured adhesive layer in the form of patterns, characters or a code, and the first structured adhesive layer is provided only outside any optically variable security feature, and wherein the second main surface is provided with a second structured adhesive layer in the form of patterns, characters or a code.

2. The security element according to claim 1, characterized in that the first main surface is provided with the first structured adhesive layer only in border regions.

3. The security element according to claim 2, characterized in that the first structured adhesive layer of the first main surface is applied in register with the optically variable security feature.

4. The security element according to claim 1, characterized in that the second structured adhesive layer of the second main surface is applied in register with the optically variable security feature of the first main surface.

5. The security element according to claim 1, characterized in that the structured adhesive layer of the first and/or second main surface includes a feature substance, especially a magnetic, electrically conductive, luminescent or infrared-absorbing feature substance.

6. The security element according to claim 1, characterized in that the optically variable security feature includes microlenses, a matte pattern, a hologram, a holographic grating image or another hologram-like diffraction pattern.

7. The security element according to claim 1, characterized in that the first structured adhesive layer of the first main surface is applied in register with the optically variable security feature.

8. The security element according to claim 1, characterized in that the first structured adhesive layer of the first main surface and the second structured adhesive layer of the second main surface are applied in register with the optically variable security feature of the first main surface.

9. A security paper for manufacturing value documents or the like, having an at least partially embedded security element according to claim 1.

10. A value document, such as a banknote, identification card or the like, having an at least partially embedded security element according to claim 1.

11. A method for manufacturing a security element for embedment in security papers, value documents and the like, having the steps of:

providing a substrate foil having opposing first and second main surfaces, providing the first main surface with an optically variable security feature having viewing-angle-dependent effects disposed on the first main surface, providing the first main surface with a first structured adhesive layer in the form of patterns, characters or a code, where the first structured adhesive layer is provided only outside any optically variable security feature, and providing the second main surface with a second structured adhesive layer in the form of patterns, characters or a code;

thereby manufacturing the security element.

12. The method according to claim 11, characterized in that the first main surface is provided with the first structured adhesive layer only in border regions.

13. The method according to claim 12, characterized in that the first structured adhesive layer of the first main surface is applied in register with the optically variable security feature.

14. The method according to claim 11, characterized in that the second structured adhesive layer of the second main surface is applied in register with the optically variable security feature of the first main surface.

15. The method according to claim 11, characterized in that the structured adhesive layer of the first and/or second main surface is applied together with a feature substance, especially a magnetic, electrically conductive, luminescent or infrared-absorbing feature substance.

16. The method according to claim 11, characterized in that the first structured adhesive layer of the first main surface is applied in register with the optically variable security feature.

17. The method according to claim 11, characterized in that the first structured adhesive layer of the first main surface and the second structured adhesive layer of the second main surface are applied in register with the optically variable security feature of the first main surface.

* * * * *